US005251387A

United States Patent [19]

Jürgens

[11] Patent Number: 5,251,387

[45] Date of Patent: Oct. 12, 1993

[54] SHOE INSOLE IN THE FORM OF A SEPARATE INSOLE INSERT OR AN INTEGRATED INSOLE ATTACHED TO THE SHOE

[76] Inventor: Ute Jürgens, Frankstr. 27, D-5000 Cologne 1, Fed. Rep. of Germany

[21] Appl. No.: 730,961

[22] PCT Filed: Jan. 24, 1990

[86] PCT No.: PCT/DE90/00042

§ 371 Date: Jul. 19, 1991

§ 102(e) Date: Jul. 19, 1991

[87] PCT Pub. No.: WO90/08486

PCT Pub. Date: Aug. 9, 1990

[30] Foreign Application Priority Data

Jan. 26, 1989 [DE] Fed. Rep. of Germany ..... 3902207

[51] Int. Cl.[5] ..... A61F 5/14; A43B 13/38

[52] U.S. Cl. ..... 36/43; 36/141

[58] Field of Search ..... 36/141, 43, 44, 71, 36/140

[56] References Cited

U.S. PATENT DOCUMENTS

| | | | |
|---|---|---|---|
| 1,730,466 | 10/1929 | Mallott | 36/44 X |
| 1,867,431 | 7/1932 | Wood | 36/44 X |
| 2,352,532 | 6/1944 | Ghez et al. | 36/141 X |
| 2,404,731 | 7/1946 | Johnson | 36/44 X |
| 3,299,893 | 1/1967 | Collina | 36/140 |
| 3,722,113 | 3/1973 | Birkenstock | 36/141 X |
| 3,757,774 | 9/1973 | Hatuno | 36/141 X |
| 4,020,570 | 5/1977 | Shames | 36/44 |
| 4,033,054 | 7/1977 | Fukuoka | 36/141 X |
| 4,047,310 | 9/1977 | Sunoo | 36/141 X |
| 4,079,526 | 3/1978 | Fukuoka | 36/44 X |
| 4,109,661 | 8/1978 | Fukuoka | 36/141 |
| 4,674,203 | 6/1987 | Göller | 36/141 X |
| 4,694,590 | 9/1987 | Greenawalt | 36/44 X |
| 4,694,831 | 9/1987 | Seltzer | 36/43 X |
| 4,727,661 | 3/1988 | Kuhn | 36/43 X |
| 4,760,655 | 8/1988 | Mauch | 36/141 X |
| 4,841,647 | 6/1989 | Turucz | 36/43 X |
| 4,932,141 | 6/1990 | Hones | 36/43 |

FOREIGN PATENT DOCUMENTS

| | | | |
|---|---|---|---|
| 2619410 | 11/1976 | Fed. Rep. of Germany | 36/141 |
| 8521944 | 10/1985 | Fed. Rep. of Germany . | |
| 1553415 | 9/1979 | United Kingdom . | |
| 2046579 | 11/1980 | United Kingdom . | |

*Primary Examiner*—Steven N. Meyers
*Assistant Examiner*—Ted Kavanaugh
*Attorney, Agent, or Firm*—K. S. Cornaby

[57] ABSTRACT

A shoe insole in the form of a separate insole or an integrated insole attached to the shoe is manufactured from a material with a consistency ranging from flexible to rigid. The upper surface which is generally smooth and which is formed to fit the sole of the foot has at least one local depression opening into the upper surface of the insole with a gently rounded rim along the entire length of its edge and having within this rim a base lying a few millimeters deeper than the intact upper surface of the insole and being in area significantly smaller than the entire surface area of the upper surface of the insole. Further on a projecting knob is arranged in the central area of this base the free tip of which lies, essentially, at the same level as the course of the intact upper surface of the insole.

10 Claims, 2 Drawing Sheets

Figure 1:
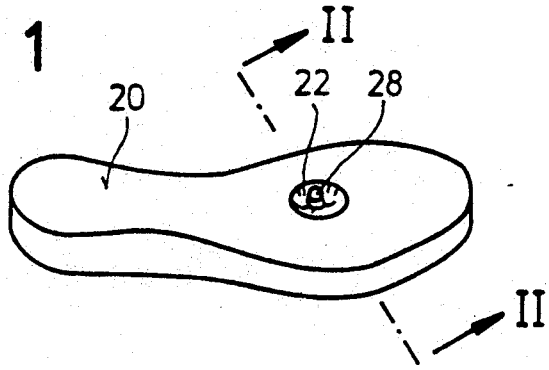

SHOE INSOLE IN THE FORM OF A SEPARATE INSOLE INSERT OR AN INTEGRATED INSOLE ATTACHED TO THE SHOE

The invention relates to a shoe insole in the form of a separate insole insert or an integrated insole attached to the shoe.

DE-U-8 521 944 teaches a shoe insole of this kind, in which below the frontal parts of the foot several grooves are provided running parallel and in a direction oblique to the length of the foot. Between them elastic transverse rips inclined towards the heel are formed, whose apexes are contiguous with the intact upper surface and have a rounded profile.

Documents U.S. Pat. No. 4,109,661, GB-A-1 553 415 and GB-A-2 046 579 disclose shoe insoles with individually positioned, generally rounded projections being above the said upper surface.

The object of the invention is to design an insole in such a way that, contrary to the teaching of DE-U-8 521 944 there is no support of a more or less identical nature across the entire surface of the sole of the foot, but to specify an insole providing in accordance with the teaching of the said three other documents a directed, specific action and stimulation to very few local areas of the sole of the human foot—preferably, when made to order for the wearer, of one localized area only—while avoiding over-stimulation.

In achieving this aim, the invention utilises the generally-known concept that each area of the sole of the humal foot can be associated with an organ in the human body; this concept is used, for example, in foot reflexology massage. The objective is to facilitate a flow of life energy which is an unrestricted as possible and thus to achieve optimal blood supply to the organs on a continual basis and thus, in turn, to promote the flow of life energy. The object so the invention is thus to design an insole in such a way that specific local areas of the sole of the foot are provided with a continual stimulating effect, in the above-described sense.

Starting from the insole of the above-mentioned kink, this object is achieved by the features of claim 1.

The shoe insole in accordance with the invention thus has an essentially smooth upper surface providing even an unstructured support for the sole of the foot. The local depression is only worked into the insole in one small area (in relation to the total area of the upper surface), said depression having a maximum horizontal dimension of, for example, 20 mm; with its preferentially circular execution this depression thus has a diameter of essentially 20 mm maximum. This means that said depression only takes up a small portion of the total area of the upper surface, thus ensuring that the kinetic energy is distributed specifically so as to be utilised naturally. The knob protrudes from the base of the depression to the height which the upper surface would have had were it to remain intact, i.e. without the presence of the local depression. The tip of said knob may protrude slightly above the intact upper surface, or terminate essentially flush with or even slightly below the same. The described arrangement has the result that a section (of relatively insignificant area) of the sole of the human foot remains unsupported; the design of said depression is such that its gently rounded rim effects a gradual transition form support to the lack of support above the base of the depression, thus reducing or preventing stoppages of kinetic energy. If at all, the base should only come into contact with the sole of the foot in the rim zone, and not in the area around the knob; the level of the base is thus adequately sunken in relation to the intact upper surface. The support in the area of the knob is provided solely by the tip of the knob itself. This makes it possible to exercise a selective pressure effect on a specific point or a small area of the sole of the human foot, namely by means of stimulation or positive motivation through massaging of principal nerves. When the wearer is standing, the selected area of the sole of the foot thus receives an essentially constant pressure or is provided with individual, mentality-specific stimulus inciting the wearer to change their standing posture and thus preventing energy stoppages; while walking or running, the sole of the foot is subjected to a continually rising and falling pressure. The stimulation or motivation is accordingly transmitted to the specific individual nerve tracts and meridians, and consequently to the organs with which they are connected, thus continually effecting the fluctuating relationship of tension and relaxation of the postural and motoric systems with muscles, tendons and ligaments. The knob is located so that it comes into contact with the desired area of the sole of the foot which is associated with the organ to be treated.

The invention thus makes it possible to perform a foot reflexology massage and an appropriate treatment of sections of the sole of the foot without requiring the continual presence of a person to perform the desired stimulation. Instead, the task of the therapist consists solely in defining, once only, which appropriate specific areas of the sole of the foot need to be stimulated; the insole is then prepared in accordance with these instructions, and the stimulation is provided whenever the footwear fitted with the insole is worn.

According to the invention, the knob has transverse dimensions of a few millimeters, preferably 4 to 6 mm. In a preferred embodiment, the knob has a circular transverse cross-section and corresponding diameter (as specified).

The execution of the tip of the knob can vary in accordance with the desired individual application. It is possible for the tip of the knob to be rounded, pointed or flattened. Corresponding transitional forms, for example with outer rounding and flattening in the centre, are also possible.

The knob itself can be executed so as to be either rigid or resilient; the preferred elasticity which is striven for is in the range of that of hard rubber. The knob has elasticity both in the direction of load, i.e. along its longitudinal axis, and at right angles to this axis; i.e. it can also bend sideways in relation to its intact longitudinal axis. These two types of elasticity are influenced by the choice of the material and by the shape of the transverse cross-section of the knob. In an embodiment of the knob executed preferentially with a foot, the lateral elasticity is reduced; the lateral elasticity is higher when the form of the knob is essentially prismatic.

The maximum total number of depressions is three (see FIG. 8); in general, each insole is provided with one single depression only, accommodating in most cases one single knob. As a basic principle, however, it is also possible to provide each depression with two or three knobs, but not more.

The knobs are preferentially executed as an integral part of the insole, forming a single connected piece with the latter; however, this does not exclude the possibility of separate execution. In particular, it is possible to provide an opening in the area of the base through which a separate knob unit can be inserted. This embodiment has the advantage that the knobs can be replaced with others. The knobs in this embodiment preferentially have a disc-like foot which is located below the actual insole and which prevents lateral angular displacement of the knob projecting from it.

Further advantages and features of the invention are revealed in the remaining claims and the following descriptions of embodiments, which are not to be understood as being restrictive and which are explained with reference to the attached diagram. Said diagram contains the following figures:

FIG. 1—A perspective representation of an insole (for a sandal) with a depression with knob in accordance with the invention.

Figure 2:
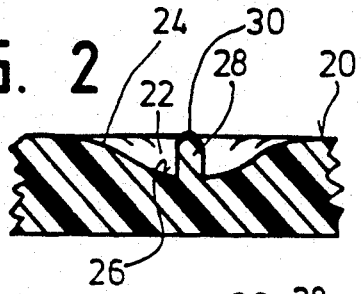

FIG. 2—A cross-section through the area of the depression with knob, comprising a sectional view through line II—II in FIG. 1.

Figure 3:
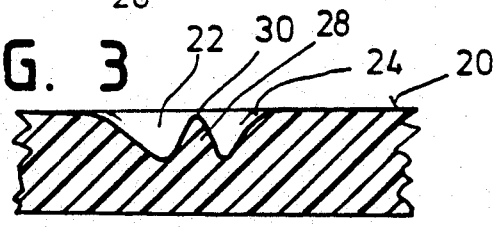

FIG. 3—A sectional view corresponding to FIG. 2 for a second embodiment.

Figure 4:
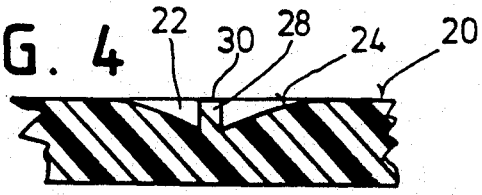

FIG. 4—A sectional view corresponding to FIG. 2 for a third embodiment.

Figure 5:
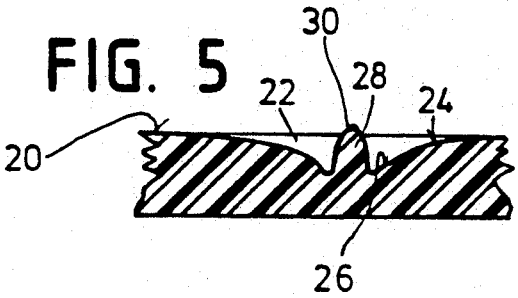

FIG. 5—A sectional view corresponding to FIG. 2 for a fourth embodiment.

Figure 6:
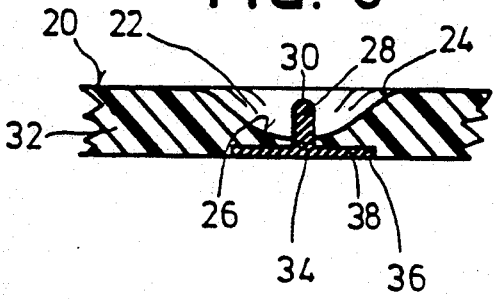

FIG. 6—A sectional view corresponding to FIG. 2 for a fifth embodiment.

Figure 7:
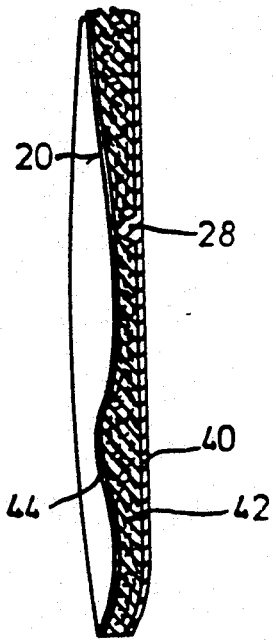

FIG. 7—A longitudinal cross-section through the toe area of an insole corresponding to a sixth embodiment.

Figure 8:
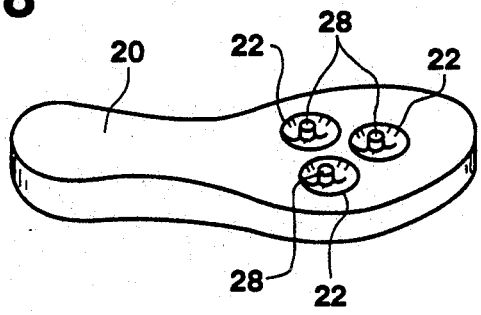

FIG. 8—A perspective representation of an insole corresponding to a seventh embodiment.

The insole of a shoe, for example a sandal, as per FIG. 1 is made of a material with the elasticity of hard rubber, in particular an appropriate rubber mixture, and has a smooth upper surface (20) contoured to fit the shape of the sole of a foot. In a very small area, not exceeding 1/10 of the total area this upper surface (20), a local depression (22) is provided which is circumscribed all around by the actual upper surface (20). Accordingly, said depression forms a transition with the (intact) upper surface, said transition taking the form of a gently rounded rim (24) in the contour of the local depression which, as can be seen in the sectional views, forms an essentially S-shaped profile from the edge to the base (26) of the depression. The level of the latter base lies a few millimeters, generally between 5 and 12 mm below the (intact) upper surface (20). A knob (28) projects from the centre of the local depression (22) and perpendicular to the upper surface (20); said knob is connected at its foot end with the base (26) and has a tip (30) which, as shown in FIG. 2, projects slightly (1 to 2 mm ) above the intact upper surface; in the other embodiments to be described below, however, the tip (30) lies either flush with or below the level of the upper surface (20).

In the embodiment as shown in FIG. 2 the knob (28) is executed as an integral part of the insole, forming one piece with the latter. It has a round transverse cross-section and a diameter of 5 mm. Its tip (30) is completely rounded, i.e. with a rounding radius of 2.5 mm. Below this tip (30) its form is prismatic, i.e. cylindrical in this embodiment. The properties of the selected insole material give the knob elasticity both in the direction parallel to the surface of the upper surface (20), the so-called lateral elasticity, and elasticity perpendicular to the upper surface (20), which means that the tip (30) is compressed downwards slightly when subjected to load.

In the embodiment illustrated in FIG. 3, the knob (28) is essentially conical, but its tip (30) is rounded. However, this tip (30) is more pointed, i.e. has a steeper rounding angle, than the tip (30) in the embodiment illustrated in FIG. 2. In addition to this, there is a gradual transition between the foot of the knob and the base (26), so that there are no sharp inside corners like those in the embodiment illustrated in FIG. 2. The knob in the embodiment illustrated in FIG. 3 has a lower lateral elasticity than that illustrated in FIG. 2.

In the embodiment illustrated in FIG. 4, the tip (30) of the knob (28) has the form of a flat circular surface, and the contact area of the knob with the sole of a foot is thus larger than in the previously described embodiments. In addition to this, the transition between the area where support is provided for the sole of a foot by the tip and the surrounding unsupported area is also abrupt. This is advantageous for certain therapies. The level of the tip (30) of the knob in the embodiment illustrated in FIG. 4 is flush with the intact upper surface (20), whereas in the embodiment illustrated in FIG. 3, the tip (30) lies slightly (max. 1 to 2 mm) below the level of the (intact) upper surface (20).

In the embodiment illustrated in FIG. 5, the knob (28) has a conical tip (30), providing even more pronounced support to one point than in the embodiment illustrated in FIG. 3.

In the embodiment illustrated in FIG. 6 it is possible to replace the knob (28). The insole here consists of a main insole component (32) in which a depression (22) in the form described above is provided; however, in the base (26) of the local depression (22) a hole (34) is provided. Below the hole (34) and in the area around the same there is a recess (36) in the main insole component (32). The execution of the knob (28) is similar to that of the embodiment illustrated in FIG. 2; its outer diameter matches the inner diameter of the hole (34), and its foot section is in the form of a disc (38), the diameter and thickness of which matches the dimensions of the recess (36).

FIG. 7 illustrates the layer structure of the main insole component (32). The latter consists of a form-giving base layer (40) approx. 2 to 3 mm thick providing the shape of the insole and made of a material which is stiff and Yet flexible, followed by a cushion layer (42) and terminated with a top layer (44) of thin suede leather with a roughened surface. The base layer (40) is shaped so as to match essentially the anatomical contours of the foot, but its contours are kept flatter than in the case of a genuine anatomical match; the lateral and longitudinal arches of the layer in particular protrude less than they would in the case of a genuine anatomical reproduction. The thickness of the material of the base layer (40) is essentially the same across its entire area; by contrast, the thickness of the cushion layer (42) varies from location to location, as illustrated in FIG. 7. This cushion layer (42) is both springy, i.e. elastic, and lastingly malleable, i.e. plastic. The elasticity is selected to provide both cushioning and distribution of pressure. As a result of its plasticity, the cushion layer (42) adapts to the form of the individual foot; the compression of the cushion layer (42) is more pronounced in the areas where the foot exerts greater pressure on it than in other areas, and the shape thus once impressed upon the cushion layer is essentially retained after several hours of wearing. A bed for the foot is thus formed which is adapted to the form of the individual foot; however, the contours of this bed are flatter than the bed of a neutral, anatomically-formed insole. The leather layer (44) forming the upper surface of the main insole component (32) is made of matt, roughened suede leather and the thickness of the material is minimal, e.g. 0.5 mm. This layer effects a slight rubbing of the foot, thus stimulating circulation, both providing and storing heat and motivating the entire sole of the foot.

Protruding from the base layer (40) and connected with it is a knob (28) of the previously described embodiment. In a new, unused insole (as illustrated in FIG. 7), the upper apex region of this knob (28) projects up to the approximate level of the leather layer (44); its body is located on all sides within the level of the cushion layer (42). Upon exposure to pressure, the cushion layer (42) is lastingly compressed as described above; the knob (28), by contrast, is significantly harder, having preferentially the elasticity of hard rubber, and its free end thus projects above the level of the leather layer (44), thus enabling the stimulation or motivation of a local area of the sole of the foot, in accordance with the invention.

It has proved to be extremely advantageous to provide an elastic cushion in the heel area, said cushion having gently receding edges at the sides without a perceptible transition to the upper surface of the main insole component (32), and rising upwards gently in its central area so that when a foot steps down contacting the insole the cushion absorbs the step energy thus allowing the specific utilisation of said energy. However, said cushion is soft and gives way, and the material of which it is made is significantly softer than that of the cushion layer (42).

The entire insole is made preferentially of natural materials.

I claim:

1. A shoe insole manufactured from a material with a consistency ranging from the elasticity of hard rubber to rigid and with an upper surface (20) which is generally smooth and which is formed to fit the sole of the foot, having at least one basin shape, local depression (22) in the upper surface of the insole, said depression opening into the upper surface (20) of the insole with a gently rounded rim (24) along the entire length of its edge and having within this rim a base (26) lying a few millimeters deeper than the upper surface (20) of the insole and being in area smaller than 1/10 of the entire surface area of the upper surface (20) of the insole, whereby in the central area of this base (26) a knob (28) having a free tip (30) which lies, essentially, at the same level as the upper surface (20) of the insole.

2. Insole according to claim 1, characterised by the fact that the knob (28) has a thickness of a few millimeters, preferentially 4 to 6 mm.

3. Insole according to claims 1 or 2, characterised by the fact that the tip of the knob (28) has a shape selected from the group consisting of rounded, pointed and flattened.

4. Insole according claim 1, characterised by the fact that the knob (28) is widened at its lower end and that said lower end forms a smooth transition to the course of the base (26).

5. Insole according to claim 1, characterised by the fact that the area of the depression (22) constitutes 1/10 to 1/20 of the total area of the upper surface (20).

6. Insole according to claim 1, characterised by the fact that the edge of the rounded rim (24) is essentially circular.

7. Insole according to claim 1, characterised by the fact that the transverse dimensions of the depression (22) are between four and ten times the size of the corresponding transverse dimensions of the knob (28).

8. Insole according to claim 1, characterised by the fact that said insole has a maximum of three depressions (22) with one knob (28) each.

9. Insole according to claim 1, characterised by the fact that the knob (28) is connected to the insole as an integral part, forming one piece with the latter.

10. Insole according to claim 1, characterised by the fact that the elasticity of the knob (28) is equivalent to that of hard rubber.

* * * * *